US005897270A

United States Patent [19]

Barel

[11] Patent Number: 5,897,270

[45] Date of Patent: Apr. 27, 1999

[54] VEHICLE HIGHWAY SYSTEM HAVING SINGLE-LEVEL UNINTERRUPTED TRAFFIC-FLOW INTERSECTION

[76] Inventor: Meir Barel, 18 Herzl Street, Hod Hasharon 45283, Israel

[21] Appl. No.: 08/845,297

[22] Filed: Apr. 25, 1997

[30] Foreign Application Priority Data

Apr. 25, 1996 [IL] Israel ..... 118035

[51] Int. Cl.[6] ..... E01C 1/00

[52] U.S. Cl. ..... 404/1

[58] Field of Search ..... 404/1

[56] References Cited

U.S. PATENT DOCUMENTS 4,986,692 1/1991 Yin-Lung ..... 404/1

*Primary Examiner*—James A. Lisehora

*Attorney, Agent, or Firm*—Ladas & Parry

[57] ABSTRACT

A highway system for vehicular traffic which includes an intersection between a main road and a secondary road, each having two traffic directions separated by a center line. The main road has a barrier along its main section for preventing direct crossing by traffic from the second road, and bypasses for each traffic direction. It further has barriers for directing traffic into the bypasses. A further barrier defines a return stretch of the bypass, the return stretch not having a barrier and being such as to permit merging of the two opposite directions of the main road traffic.

6 Claims, 1 Drawing Sheet

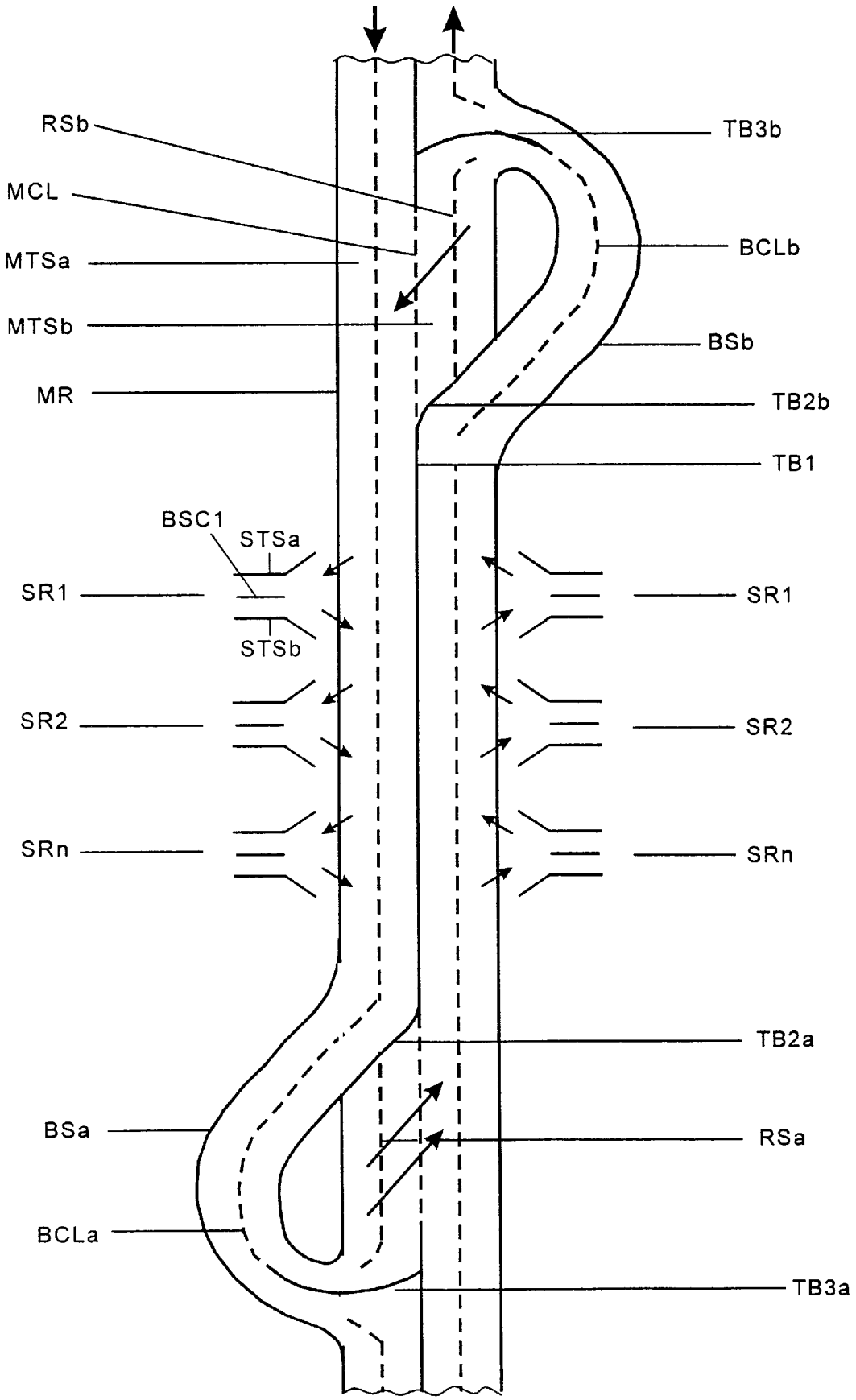
RSb
MCL
MTSa
MTSb
MR
TB3b
BCLb
BSb
TB2b
TB1
BSC1
STSa
STSb
SR1
SR2
SRn
SR1
SR2
SRn
TB2a
BSa
RSa
BCLa
TB3a

VEHICLE HIGHWAY SYSTEM HAVING SINGLE-LEVEL UNINTERRUPTED TRAFFIC-FLOW INTERSECTION

BACKGROUND OF THE INVENTION

1. Field of the Invention

The present invention relates to a vehicle highway system, and particularly to one having single-level intersections capable of uninterrupted traffic flow.

2. Description of Related Art

Highway systems which include intersections of a major road with secondary roads generally include either a stop sign or a traffic signal light in order to permit the traffic on the secondary road to cross the main road. If the traffic on the main road is relatively heavy, the danger of an accident occurring when a vehicle on the secondary road attempts to cross the main road generally requires that a traffic control signal be provided at the intersection, but such a signal seriously interrupts the continuous flow of the traffic on the main road. In many cases, this problem is answered by building overpasses or underpasses to permit the traffic on the secondary roads to cross the main road without interrupting the main road traffic, but such overpass and underpass constructions are relatively expensive.

SUMMARY OF THE INVENTION

An object of the present invention is to provide a highway system having single-level intersections capable of uninterrupted traffic flow.

According to the present invention, there is provided a highway system for vehicular traffic including an intersection of a major road and a secondary road each having traffic sections of opposite directions separated by a center line; the major road including: a first barrier along its center line preventing traffic on the secondary road from directly crossing the main road; a bypass stretch for each direction section of the main road and at a predetermined distance forwardly of the intersection in the traffic direction on the respective section, each bypass stretch having an entrance end, an exit end, and a lane-dividing line at the exit end; a second barrier for each direction section of the main road directing all the traffic in the respective section into the entrance end of the respective bypass stretch; and a third barrier for each direction section of the main road forwardly of the second barrier in the traffic direction to define a return stretch of the main road between the second and third barriers bypassed by the bypass stretch; the third barrier extending from the lane-dividing line at the exit end of the respective bypass stretch to the center line of the main road to thereby direct the traffic exiting the bypass stretch on one side of its lane-dividing line in the reverse direction onto the reverse stretch of the main road, and the traffic exiting the bypass stretch on the opposite side of its lane-dividing line in the forward direction onto the main road; the return stretch of the main road being devoid of a barrier along its center line to permit the traffic thereon to merge with the traffic on the main road travelling in the opposite direction.

As will be described more particularly below, such a highway system permits the traffic on the secondary roads to enter or cross the main road without interrupting the traffic on either road, and without the need for overpasses or underpasses with respect to the main road.

BRIEF DESCRIPTION OF THE DRAWING

Further features of the invention will be apparent from the description below of one form of highway system constructed in accordance with the present invention as illustrated in the attached single drawing figure which shows a main road intersected by a plurality of secondary roads.

DESCRIPTION OF THE PREFERRED EMBODIMENTS

The highway system illustrated in the attached drawing includes a main road MR intersected by a plurality of secondary roads $SR_1$–$SR_n$ along the length of the main road. The main road MR includes a center line MCL dividing the road into traffic section MTSa having one or more lanes for carrying the traffic in one direction, and traffic section MTSb having one or more lanes for carrying the traffic in the opposite direction. Similarly, each of the secondary road $SR_1$–$SR_n$ also includes a center line (e.g., SCL road for secondary road $SR_1$) dividing the road into a traffic section STSa for carrying the traffic in one direction, and a traffic section STSb for carrying the traffic in the opposite direction.

In the example illustrated in the drawing, the main road is a four-lane road including two lanes for each direction, and the secondary roads $SR_1$–$SR_n$ are two-lane roads including a single lane for each direction. It will be appreciated, however, that such an arrangement is illustrated merely for purposes of example, and that the invention is capable of application in many other types of highway constructions.

The main road MR is provided with a traffic barrier $TB_1$ extending along its center line at each of the intersections with the secondary road $SR_1$–$SR_n$ preventing traffic on the respective secondary road from directly crossing the main road. In the example illustrated in the drawing, traffic barrier $TB_1$ is common for the intersections of all the secondary roads $SR_1$–$SR_n$ illustrated in the drawing, but it will be appreciated that there could be a separate barrier at each intersection particularly if the intersections are spaced substantial distances apart.

The main road MR further includes a bypass stretch for each direction section of the main road and at a predetermined distance forwardly of the intersection in the traffic direction of the respective section. Thus, as shown in FIG. 1, a bypass stretch BSa is provided for the traffic carried by traffic section MTSa of the main road MR forwardly of the all the illustrated secondary roads $SR_1$–$SR_n$ in the direction of the traffic flow; similarly, a bypass stretch BSb is provided for the opposite traffic section MTSb of the main road MR forwardly of all the illustrated intersections with the secondary roads $SR_1$–$SR_n$ in the direction of traffic flow.

Each of the bypass stretches BSa, BSb includes an entrance end for receiving the traffic from the respective section of the main road, and an exit end for returning the traffic to the respective section of the main road. In addition, each of the bypass stretches BSa, BSb, at least their exit ends, includes a lane-dividing or center line BCLa, BCLb, defining at least two lanes of traffic exiting from the respective bypass stretch.

The main road MR further includes a second traffic barrier $TB_{2a}$, $TB_{2b}$, for each direction section of the main road. These traffic barriers are connected to the center line MCL of the main road so that they direct all the traffic in the respective section of the main road into the entrance end of the respective bypass stretches BSa, BSb.

The main road MR includes a third traffic barrier $TB_{3a}$, $TB_{3b}$ for each direction section of the main road at the exit end of each bypass stretch BSa, BSb, i.e., fowardly of the second traffic barriers $TB_{2a}$, $TB_{2b}$ in the traffic direction. These third traffic barriers $TB_{3a}$, $TB_{3b}$, extend from the lane-dividing or center line at the exit end of the respective bypass section BSa, BSb to the center line MCL of the main road MR. Barriers $TB_{3a}$, $TB_{3b}$ are therefore effective to direct the traffic exiting from the right side of the center line at the exit of the respective bypass stretch BSa, BSb, onto the main road MR in the direction of traffic travel in the respective section, so that the forwardly-travelling traffic continues in the same direction. These barriers, however, direct the traffic exiting from the respective bypass stretches BSa, BSb on the left side of the center line at the exit of the respective bypass stretch in the reverse direction onto a return stretch RSa, RSb of the main road MR extending between the two barriers $TB_{2a}$, $TB_{3a}$ and $TB_{2b}$, $TB_{3b}$ bypassed by the respective bypass stretch BSa, BSb.

It will thus be seen that the traffic in each of the bypass stretches RSa, RSb, travels in the reverse direction to the traffic in the corresponding sections of the main road MR. As shown in the drawing, these reverse stretches are RSa, RSb of the main road are devoid of a barrier along the center line MCL of the main road. These reverse stretches therefore permit the traffic thereon to merge with the traffic travelling in their respective directions in the opposite sections of the main road, as shown by the arrows in the reverse stretches RSa, RSb. The traffic which is to continue in the same direction would remain in the left side of the respective section of the main road MR, whereas the traffic to exit from the main road MR via one of the secondary roads $SR_1$–$SR_n$, would edge to the right of the respective section of the main road MR to enable it to leave at the desired secondary road.

Thus, if the traffic on the secondary road $SR_1$ was merely to cross the main road MR, such traffic in the reverse stretch RSa, RSb would leave the main road via the secondary road $SR_1$, thereby in effect crossing the main road without any interruption in the traffic flow.

Since the traffic travelling on the main road MR on opposite sides of the second traffic barrier $TB_{2a}$, $TB_{2b}$ is travelling in opposite directions, barriers $TB_{2a}$, $TB_{2b}$ should also be optical barriers, i.e., also blocking the view of the traffic approaching the opposite sides of the barrier.

It will thus be seen that the system illustrated in the drawing permits the traffic to flow from any of the secondary roads $SR_1$–$SR_n$ across the main road MR or onto the main road without any interruption in the traffic flow along either the main road MR or any of the secondary roads $SR_1$–$SR_n$. It will also be seen that such an arrangement does not require overpasses or underspasses, and therefore all the intersections may be construction in the same level.

While the invention has been described with respect to one preferred embodiment, it will be appreciated that this is set forth merely for purposes of example, and that many other variations, modifications and applications of the invention may be made.

I claim:

1. A highway system for vehicular traffic including an intersection of a major road and a secondary road each having traffic sections of opposite directions separated by a center line; said major road including:

a first barrier along its center line preventing traffic on said secondary road from directly crossing the main road;

a bypass stretch for each direction section of the main road and at a predetermined distance forwardly of the intersection in the traffic direction on the respective section, each bypass stretch having an entrance end, an exit end, and a lane-dividing line at the exit end;

a second barrier for each direction section of the main road directing all the traffic in the respective section into the entrance end of the respective bypass stretch;

and a third barrier for each direction section of the main road forwardly of said second barrier in the traffic direction to define a return stretch of the main road between said second and third barriers bypassed by said bypass stretch;

said third barrier extending from the lane-dividing line at the exit end of the respective bypass stretch to the center line of the main road to thereby direct the traffic exiting the bypass stretch on one side of its lane-dividing line in the reverse direction onto said return stretch of the main road, and the traffic exiting the bypass stretch on the opposite side of its lane-dividing line in the forward direction onto said main road;

said return stretch of the main road being devoid of a barrier along its center line to permit the traffic thereon to merge with the traffic on the main road travelling in the opposite direction.

2. The highway system according to claim 1, wherein each of said second barriers is also an optical barrier blocking the view of the traffic approaching the opposite sides of said second barrier.

3. The highway system according to claim 2, wherein there are a plurality of said intersections of the main road with a plurality of said secondary roads, there being a said first barrier for each of said intersections, and a said bypass stretch, second barrier and third barrier common to said plurality of intersections.

4. The highway system according to claim 3, wherein said first barrier extends continuously along the center line of said main road except for said return stretch of the main road.

5. The highway system according to claim 1, wherein there are a plurality of said intersections of the main road with a plurality of said secondary roads, there being a said first barrier for each of said intersections, and a said bypass stretch, second barrier and third barrier common to said plurality of intersections.

6. The highway system according to claim 5, wherein said first barrier extends continuously along the center line of said main road except for said return stretch of the main road.

* * * * *